US005232461A

United States Patent [19]

Ghorashi

[11] Patent Number: 5,232,461

[45] Date of Patent: Aug. 3, 1993

[54] METHOD OF DYEING AROMATIC POLYAMIDE FIBERS WITH WATER-SOLUBLE DYES

[75] Inventor: Hamid M. Ghorashi, Midlothian, Va.

[73] Assignee: E. I. du Pont de Nemours and Company, Wilmington, Del.

[21] Appl. No.: 889,344

[22] Filed: May 28, 1992

[51] Int. Cl.[5] ..... D06P 7/00; C09B 44/00

[52] U.S. Cl. ..... 8/489; 8/491; 8/494; 8/497; 8/654; 8/657; 8/925

[58] Field of Search ..... 8/654, 657, 491, 497, 8/489, 494

[56] References Cited

U.S. PATENT DOCUMENTS

| | | | |
|---|---|---|---|
| 2,747,233 | 5/1956 | Hitt | 19/66 |
| 3,767,756 | 10/1973 | Blades | 264/184 |
| 3,869,429 | 3/1975 | Blades | 528/341 |
| 4,144,023 | 3/1979 | Provost | 8/489 |
| 4,985,046 | 1/1991 | Hartzler | 8/654 |
| 4,994,323 | 2/1991 | Lee | 8/925 |
| 5,096,459 | 3/1992 | Ghorashi | 8/584 |

*Primary Examiner*—A. Lionel Clingman

[57] ABSTRACT

Poly(p-phenylene terephthalamide) (PPD-T) fibers which have been dried are dyed with cationic dyes, or with disperse or acid dyes, by heating the fibers under a high pressure from 29 to 108 psi and at a temperature from 130° to 180° C.

5 Claims, No Drawings

METHOD OF DYEING AROMATIC POLYAMIDE FIBERS WITH WATER-SOLUBLE DYES

BACKGROUND OF THE INVENTION

1. Field of the Invention

The field of art to which this invention pertains is aromatic polyamide fibers and, more particularly, it is directed to a method of dyeing these fibers.

Specifically, the instant invention is a method of dyeing a fiber structure of poly(p-phenylene terephthalamide (PPD-T) fibers or filaments with a water-soluble cationic dye. The fibers are dyed in a dye bath at a high pressure from about 29 to 108 psi at a temperature of from 130° to 180° C. for a time sufficient to dye the fibers. Preferably such fibers are heated to a temperature in excess of 150° C., during the dyeing operation. These fibers, which are preferably dried prior to being placed in the dye bath, can be dyed as tow or in the form of staple fibers or yarns or fabrics.

By following the method of this invention, dried PPD-T fibers may be efficiently dyed a bright deep color with highly compatible water-soluble dyes without loss of dye effectiveness.

2. Description of the Related Art

Aromatic polyamide fibers are known to the art. They have outstanding properties such as high tensile strength, high modulus, flame and heat resistance, and good flex life which make them suited to be formed into fabrics usable as protective clothing, and for many other uses.

More specifically, this invention is directed to a method of dyeing aromatic polyamide fibers of a poly(p-phenylene terephthalamide) polymer, hereinafter referred to as PPD-T fibers. Such fibers which are described in greater detail in U.S. Pat. Nos. 3,767,756 to Blades; 3,869,429, also to Blades and 4,144,023 to Provost, for example, possess many useful properties, as indicated above. The teachings of these patents are incorporated herein by reference.

It is well-known that aromatic polyamide fibers and particularly PPD-T fibers are difficult to dye. As a result, various methods have evolved, over the years, for dyeing poly(p-phenylene terephthalamide, (PPD-T) fibers in various forms.

The most generally accepted method of dyeing PPD-T fibers has been to dye the fibers, after they have been crimped, in a pressure vessel at 121° to 132° C. temperatures, using an aqueous dyebath containing a large percentage of a carrier, such as acetophenone. This method has proven to be effective for dyeing dried PPD-T fibers with water-soluble dyes. However, the large amount of carrier involved can present certain cost and dyebath disposal problems to the user. Further, several hours are generally required to achieve the depth of color desired in the finished product. Also, this method is more suitable for dyeing fabric or staple fibers.

Another method suitable for dyeing crimped PPD-T fibers is shown in U.S. Pat. No. 4,144,023 to Provost. In this method high strength, high modulus aromatic polyamide PPD-T fibers are dyed by crimping the fibers while wet to at least 10 crimps per inch and maintaining at least 15% by weight moisture based on the dry fibers in the fibers at all times before dyeing. These fibers are preferably dyed at 121° C. under pressure for a number of hours. Effective K/S values (apparent dye depth levels) are obtained using this method. If the fiber is dried before dyeing, a much lower K/S value is obtained. Only a limited number of cationic dyes are suitable for use in this dyeing method.

Accordingly, a method has long been sought for dyeing PPD-T fibers, which have been dried prior to dyeing, using commercially available water-soluble dyes, without the need of a carrier, to obtain a wide range of colors while retaining good fibers properties. It has been especially desired to achieve a method for applying such dyes at relatively low temperatures, e.g., around 165° C. (and under 200° C.), since many otherwise desirable dyes are unstable at higher temperatures. And, it further has been desired to be able to dye PPD-T fibers in staple form or PPD-T fibers in the form of yarns or fabric effectively with cationic dyes using commercially available dyeing equipment.

This invention solves these and other problems found in the prior art by surprisingly finding that dried PPD-T fibers in the form of staple or yarn or fabric may be effectively dyed under high pressure conditions using a wide range of cationic dyes without need for a carrier. Specifically, it has been found that such fibers may be dyed with water-soluble dyes at high pressures of 29 to 108 psi and temperatures from 130° C. to 180° C. These fibers may be dyed to acceptable levels using dyeing equipment and techniques known to the art. In so doing, the method of this invention provides the art with an effective, improved means of dyeing PPD-T fibers with a large variety of water-soluble dyestuff.

SUMMARY OF THE INVENTION

Briefly described, this invention is a method of dyeing a tow of poly(p-phenylene terephthalamide) (PPD-T) fibers, which have been previously dried, comprising the steps of placing the fibers in an aqueous bath containing about 0.5 to 5 wt. % of a water-soluble dye, based on the weight of the fibers, and thereafter heating the fibers under a high pressure of 29 to 108 psi at a temperature from about 130° C. to 180° C. for a time sufficient to dye the fibers. Preferably the fibers are heated to a temperature over 150° C., using this method.

PPD-T fibers may be effectively dyed with cationic dyes by this method.

Preferably the fibers are dry and have been crimped prior to being placed in the bath. Such fibers may be crimped to between 7 to 15 crimps per inch; preferably they are crimped to about 10 crimps per inch. The fibers are preferably dyed with cationic, water-soluble dyes, and without use of a carrier.

DESCRIPTION OF THE PREFERRED EMBODIMENTS

This invention is a method of dyeing aromatic polyamide fibers.

More specifically, the method of this invention is particularly suited to dyeing poly(p-phenylene terephthalamide) (PPD-T) fibers with water-soluble dyes, using high pressure dyeing techniques. These fibers are available commercially, for example, from E. I. du Pont de Nemours and Company under the trademark KEVLAR. Such fibers are made using methods well-known in the art.

Briefly described, the preferred high strength, high modulus fibers which may be dyed using the method of the present invention are poly(p-phenylene terephthalamide) (PPD-T) fibers prepared by the process described in U.S. Pat. No. 3,767,756. Other high strength, high modulus fibers prepared by the process of U.S. Pat. No. 3,767,756 may also be used. These fibers are prepared from aromatic polyamides containing divalent aromatic radicals in which the chain extending bonds of the radicals are substantially coaxial or parallel and oppositely directed and are connected by amide (-NHCO-) linkages. The radicals may also be linked by vinylene, ethynylene, azo or azody radicals. A portion of the aromatic radicals may be replaced with trans-1,4-cyclohexylene radicals.

Briefly, these fibers are typically prepared by extruding the polymer through orifices in a spinneret to form strand-like individual filaments which are combined to form a tow. The tow is dried using known air drying techniques. Such dried tow is then generally cut to form staple fibers which are later spun into yarns or fabrics using known techniques.

If desired, the tow can be crimped prior to drying using a stuffer box crimper, such as is that shown in U.S. Pat. No. 2,747,233 to Hitt. The crimped fibers are then preferably dried and the tow cut into staple fibers prior to further processing. If desired, the fibers could be dried after being cut into staple fibers or even as yarn.

In all of these embodiments, it is always preferred in the practice of the method of this invention that the fibers should be dried, prior to dyeing. This is the preferred form of the commercial fibers involved in this invention. Typically, such fibers are shipped to the user, either as dried staple (or tow) or is spun into yarn or fabric, which is dried prior to shipment. The fibers are then dyed.

The fibers which are dyed using the method of this invention can be in the form of:

Tow of continuous PPD-T filaments
Staple fibers
Yarns of staple fibers or continuous filaments
Fabrics made of such yarns The dyes used are preferably cationic (basic) dyes.

Preferably the fibers are crimped between 7 to 15 crimps per inch (3 to 6 crimps per cm.); about 10 crimps per inch (3.9 crimps per cm.) is preferred.

Preferably, in one embodiment of the method of this invention, the PPD-T fibers are dyed with cationic dyes, using batch, pressure dyeing techniques. Other dyes and dyeing methods are also suitable. For example, the fibers, which are preferably crimped, may be dyed with cationic dyes using a pad dyeing procedure with atmospheric steaming. Disperse or acid dyes may also be used but cationic dyes are preferred.

The staple fibers which were used in the following examples were commercially available crimped staple fibers of poly(p-phenylene terephthalamide) (PPD-T) having an initial modulus of about 515 g/dtex (grams per decitex), a cut length of 5 cm (2 in.), a crimp frequency of about 4 crimps per cm (10 crimps per in.), and a linear density of 1.65 dtex (1.5 dpf) (available as Type 29 "Kevlar" aramid fiber from E. I. du Pont de Nemours and Company, Inc.). The fibers, as produced and sold, are distinctly golden in color.

In the examples, color determinations were made using a colorimeter (Hunter Tristimulus Colorimeter model D25M-9, available commercially from Hunter Associates Laboratory, Inc., 11045 Sunset Hills Rd., Reston, Va., USA). The color and shade depth for the various samples of dyed crimped staple fibers were determined by measuring the Hunter "L", "a", and "b" values in the conventional manner. The "L" color component is a measure of the blackness or whiteness of the sample, while the "a" value is a measure of where the color of the sample is in the red to green range and the "b" value is a measure of where the color of the sample is in the blue to yellow range.

EXAMPLE 1

Thirty g of crimped PPD-T fibers were placed in a bath of 500 mL of water in which 2 g of Basic Blue 6 dye and 30 mL of acetic acid had been dissolved, the bath being contained in a pressure vessel. The bath was heated until the pressure reached 414 kPa (60 psi), corresponding to a temperature of 155° C., and heating was continued so as to maintain the bath at that pressure for 1.5 hours. The fibers were dyed to a deep, uniform shade of brown with good dye bath exhaustion (it being noted that the effect of this particular blue dye on the golden colored fibers was to dye them brown). The Hunter "L" value for this fiber sample was 23.38, and the "a" and "b" values were 0.13 and 0.26, respectively.

The example was repeated, except that more heat was applied so as to achieve a pressure of 552 kPa (80 psi), corresponding to a temperature of 165° C., heating being continued so as to maintain the bath at that pressure for 1.5 hours. The fibers were dyed to an even deeper, uniform shade of brown with excellent dyebath exhaustion. The Hunter "L" value for this fiber sample was 20.28, and the "a" and "b" values were 0.67 and 0.89, respectively.

The example was repeated again, except that the bath was only heated until the pressure reached 104 kPa (15 psi), corresponding to a temperature of 121° C. The fibers were only tinted in a non-uniform manner to mixed shades of light brown and grayish-brown. The Hunter "L" value for this fiber sample was 26.15, and the "a" and "b" values were 0.51 and −1.90, respectively. The example was repeated once more, heating to a pressure of only 55 kPa (8 psi), corresponding to a temperature of 113° C. These fibers were only lightly tinted in a non-uniform manner to mixed shades of light grayish-brown. The Hunter "L" value for this last fiber sample was 23.48, and the "a" and "b" values were 1.13 and −3.21, respectively.

EXAMPLE 2

Fifty g of crimped PPD-T fibers were placed in a bath of 750 mL of water in which 3 g of Basic Blue 6 dye and 1 g of Basic Blue 54 dye had been dissolved, the bath being contained in a pressure vessel. Thirty mL of acetic acid and 0.05 g of dispersing agent (Emcol P50-59) was then added to the bath. The bath was then heated until the pressure reached 380 kPa (55 psi), corresponding to a temperature of 153° C., and heating was continued so as to maintain the bath at that pressure for 2.5 hours. The bath was then cooled down, 19 g of sodium sulfate was added, and the bath was reheated to 380 kPa for another 30 minutes. The fibers were dyed to a very deep, uniform shade of brown with excellent dye bath exhaustion. The Hunter "L" value for this fiber sample was 18.00, and the "a" and "b" values were 0.61 and 0.71, respectively.

EXAMPLE 3

Example 2 was repeated, except that the dyes added to the bath were 3 g of Basic Blue 54 dye and 0.05 g of Basic Red 46 dye and the bath was heated until the pressure reached 345 kPa (50 psi), corresponding to a temperature of 150° C., the bath being reheated until the same was reached after it was cooled and the sodium sulfate was added. The fibers were dyed to a deep shade of blue with good dye bath exhaustion. The Hunter "L" value for this fiber sample was 23.29, and the "a" and "b" values were 4.81 and −20.77, respectively.

I claim:

1. A method of dyeing poly(p-phenylene terephthalate) fibers including the steps of:

placing the dry and crimped fibers in an aqueous bath containing a cationic, basic water-soluble dye, heating the fibers under a pressure of 29 to 108 p.s.i. and a temperature of 130° to 180° C. for a time sufficient to dye the fibers.

2. The method of claim 1 wherein the fibers are crimped to between 7 to 15 crimps per inch.

3. The method of claim 1 wherein the fibers are crimped to about 10 crimps per inch.

4. The method of claim 1 wherein the fibers are dyed without use of a carrier.

5. The method of claim 1 wherein the fibers are heated to a temperature of 150° to 180° C. for a time sufficient to dye the fibers.

* * * * *